United States Patent [19]

Naka et al.

[11] 4,220,316

[45] Sep. 2, 1980

[54] TOP RAIL FOR USE ON RAILING CONSTRUCTION

[75] Inventors: Hiromitsu Naka; Takeshi Miyashiro; Hidetoshi Kawase; Yoshihde Sugimoto, all of Saitama-ken; Tsutomu Shirataki; Hiroshi Morishita, both of Hokkaido, all of Japan

[73] Assignee: Kabushiki Kaisha Naka Gijutsu Kenkyusho, Sapporo, Japan

[21] Appl. No.: 926,743

[22] Filed: Jul. 21, 1978

[30] Foreign Application Priority Data

May 27, 1978 [JP] Japan ..... 53/62166

[51] Int. Cl.[2] ..... E04H 17/14

[52] U.S. Cl. ..... 256/59; 256/1

[58] Field of Search ..... 256/59, 65, 66, 67, 256/68, 69, 70, 72, 1

[56] References Cited

U.S. PATENT DOCUMENTS

| | | | |
|---|---|---|---|
| 2,869,829 | 1/1959 | Spanberg | 256/65 |
| 3,164,354 | 1/1965 | Murdock | 256/65 X |
| 3,258,250 | 6/1966 | McMullin | 256/68 X |
| 3,704,861 | 12/1972 | Glaesener | 256/13.1 |
| 3,784,167 | 1/1974 | Glaesener | 256/13.1 |
| 3,963,218 | 6/1976 | Glaesener | 256/13.1 |
| 3,982,735 | 9/1976 | Fornells | 256/59 |
| 3,991,981 | 11/1976 | Wu | 256/65 |

*Primary Examiner*—Andrew V. Kundrat

*Attorney, Agent, or Firm*—Wenderoth, Lind & Ponack

[57] ABSTRACT

A top rail for use in connection with a railing construction or the like is constituted by a main top rail member, a resilient cushion layer fitted on the main top rail member, and a surface portion layer integrally formed with the outer surface of the resilient cushion layer. the main top rail member has a support post receiving slot extending in the longitudinal direction of the top rail and opening downwardly.

10 Claims, 19 Drawing Figures

TOP RAIL FOR USE ON RAILING CONSTRUCTION

This invention relates to a top rail for use in connection with a railing construction and more particularly, to a top rail for use in connection with the railing construction on a staircase in a building or ship or in connection with the railing construction on a staircase wall face, floor wall face, window or balcony.

The top rails for the above-mentioned purposes generally comprise a supporting section to be secured to staircase posts such as bars, balusters, baluster bars, pickets, spindles or upright members or mounting brackets and a vinyl hand rail fitted on the supporting section and the installation of the vinyl hand rail on the supporting section is effected by the use of a hot air blower with a canvas sleeve attached thereto.

In order that the top rail can exhibit an excellent cushioning effect, the hand rail has to be formed of soft cushioning material, that is, soft synthetic resin or rubber.

Since such soft synthetic resin or rubber tends to have an inherent bleeding phenomenon and/or surface irregularity brought about when the material is formed into the hand rail, the obtained hand rail generally has an unpleasant appearance.

Therefore, one object of the present invention is to provide a top rail for use in connection with a railing construction or the like which has an excellent cushioning effect and an excellent touch, which has a pleasant appearance and high wear-resistance and which is less vulnerable to flaws.

Another object of the present invention is to provide a top rail for use in connection with a railing construction or the like which eliminates the necessity of the use of a hot air blower in the installation of the vinyl hand rail on the main top rail member to thereby make it easy to attach the resilient cushion layer to the main top rail member with sufficient firmness.

Another object of the present invention is to provide a top rail which is rigid and which can be simply secured to staircase posts or mounting brackets.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

Figure 1:
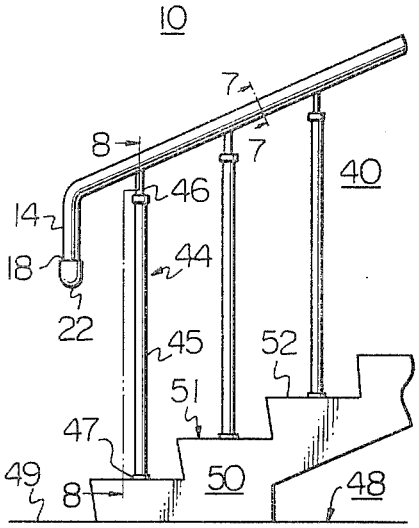
FIGS. 1 through 4 are fragmentary side elevational views of a staircase to which one embodiment of the top rail according to the present invention is applied.

The present invention will be now described referring to the accompanying drawings in which the embodiments of the top rail are shown as being applied to the railing construction of a staircase or the like.

Referring to FIGS. 1 through 8 of the drawings, the railing constructions of a staircase 50 to which the top rails 10, 11, 12 and 13 of the invention are, respectively, applied are shown by reference numerals 40, 41, 42 and 43, respectively.

Each of the railing constructions 40, 41, 42 and 43 includes the top rail 10, 11, 12 or 13 and a plurality of upright support posts 44 which are spaced and parallel to each other. The top rail 10, 11, 12 or 13 is attached to the upper ends of the support posts 44 bridging the support posts 44.

Each of the support posts 44 comprises a main or lower support post portion 45 and an auxiliary or upper support post portion 46 which has the diameter smaller than that of a main support post portion 45. The lower end of the main support post portion 45 is fixedly secured to the footboard 52 of the associated step 51 in the staircase 50 and covered by a floor cover flange 47.

Figure 2:
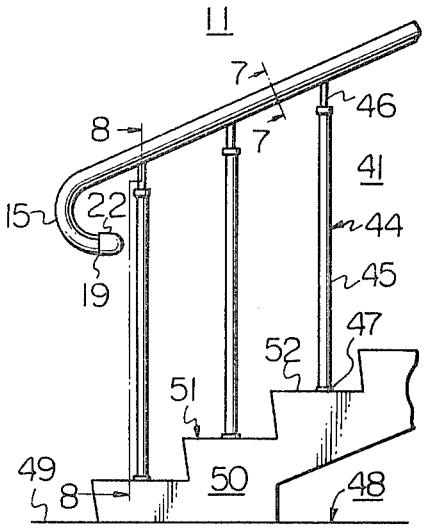
Figure 3:
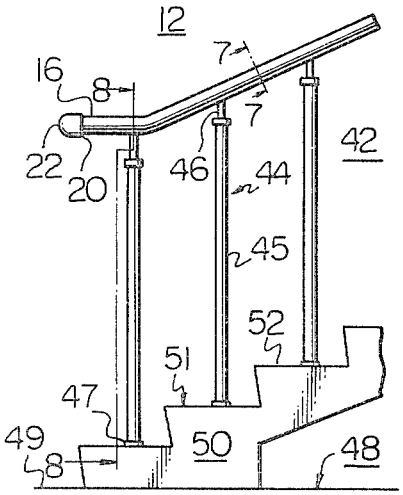
Figure 4:
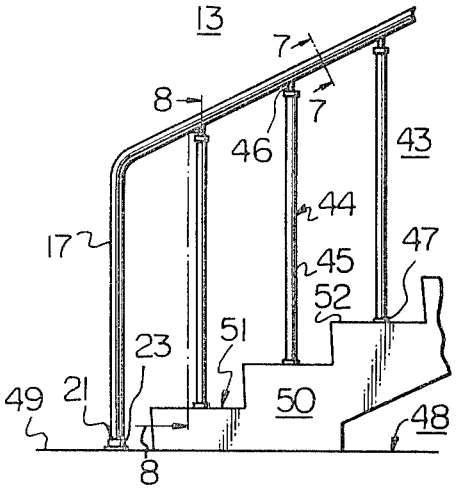
Figure 5:
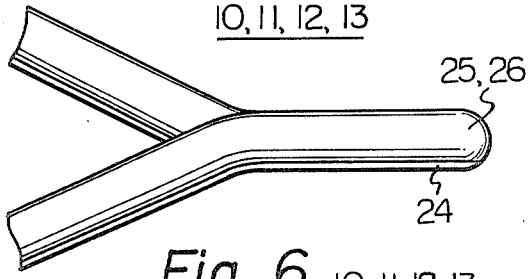
FIG. 5 is a fragmentary side elevational view on an enlarged scale showing the bent lower end of said top rail positioned adjacent to the lowermost step of the staircase.
Figure 6:
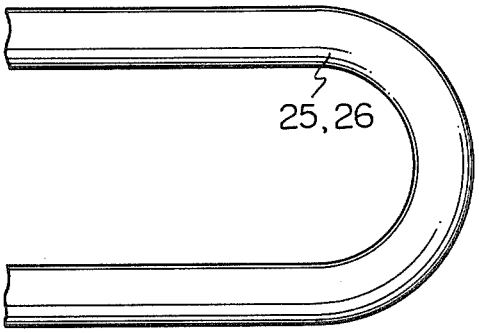
FIG. 6 is a plan view of said bent lower end of the top rail as shown in FIG. 5.

The lower end portion 14 of the top rail 10 applied to the railing construction 40 as shown in FIG. 1 extends beyond the lowermost support post 44 on the lowermost step 51 in the staircase 50 and is bent downwardly parallel to the support posts 44. The lower end portion 15 of the top rail 11 applied to the railing construction 41 as shown in FIG. 2 extends beyond the lowermost support post 44 on the lowermost step 51 in the staircase 50 and is bent downwardly and inwardly. The lower end portion 16 of the top rail 12 applied to the railing construction 42 as shown in FIG. 3 extends beyond the support post 44 on the lowermost step 51 in the staircase 50 and is bent so as to assume a horizontal attitude. The lower end portion 17 of the top rail 13 applied to the railing construction 43 as shown in FIG. 4 extends beyond the lowermost step 51 in the staircase 50 and is bent downwardly parallel to the support posts 44 to reach the floor 49 of the building 48. The extreme ends 18, 19 and 20 of the top rails 10, 11 and 12 applied to the railing constructions 40, 41 and 42 as shown in FIGS. 1 through 3, respectively, have end caps 22 attached thereto and the extreme end 21 of the top rail 13 applied to the railing construction 43 as shown in FIG. 4 is secured to the building floor 49 through a socket 23.

Figure 7:
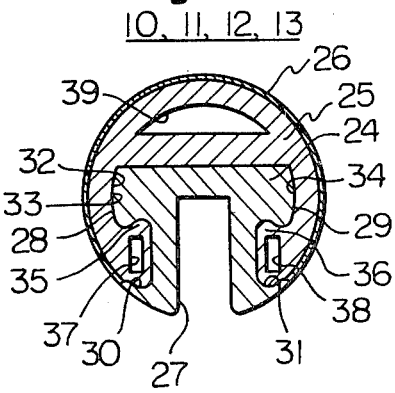
FIG. 7 is a cross-sectional view taken substantially along the line 7—7 of FIGS. 1 through 4.
Figure 8:
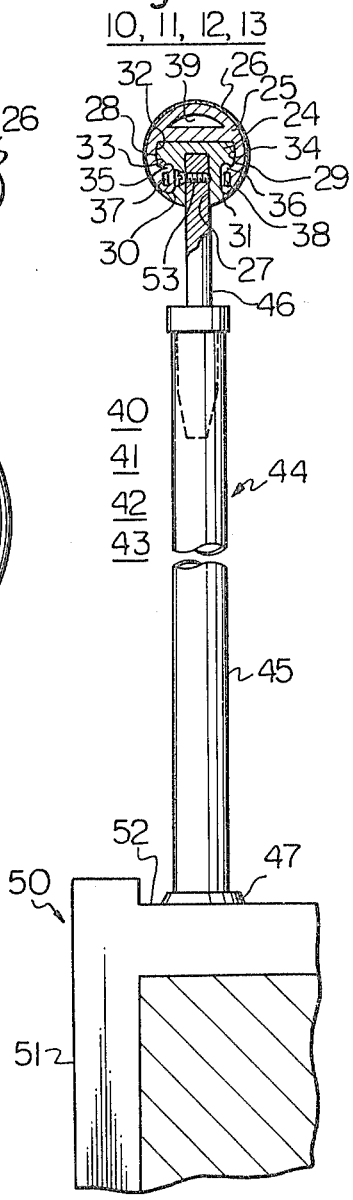
FIG. 8 is a cross-sectional view taken substantially along the line 8—8 of FIGS. 1 through 4.

As more clearly shown in FIGS. 7 and 8, the top rails 10, 11 and 12 have a circular cross-section throughout their length and each of the top rails comprises a main top rail member 24, a resilient cushion layer 25 and a surface protection layer 26. Especially, the top rail 10, 11, 12 or 13 is preferably constructed by integrally forming the resilient cushion and surface protection layers 25 and 26 and then incorporating the integral layer assembly into the main top rail member.

The main top rail member 24 is formed by extruding aluminum or an alloy thereof and has a slot 27 extending in the longitudinal direction of the associated top rail 10, 11, 12 or 13 and opening downwardly for receiving the support posts therein. Similarly, the main top rail member 24 has on the left- and right-hand sides 28 and 29 (as seen in FIG. 7) thereof dovetail tenon slots 30 and 31 on the opposite sides of the slot 27. The main top rail member 24 is, of course, constituted by connecting the straight intermediate portion, lower end portion and upper end portion together by means of metallic joints (not shown).

The resilient cushion layer 25 applied or fitted about the main top rail member 24 is formed by continuously extruding thermoplastic resins such as non-rigid polyvinyl chloride, polyolefins, and synthetic rubber through a suitable extruder or an extruding die and has a groove 32 extending in the longitudinal direction of the associated top rail 10, 11, 12 or 13 and opening downwardly for receiving the main top rail member 24.

The resilient cushion layer 25 also includes dovetail tenons 35 and 36 integrally formed with and projecting from the opposite inner surfaces 33 and 34 of the main top rail member receiving groove 32, respectively and the dovetail tenons 35 and 36 are adapted to be fitted in the dovetail tenon slots 30 and 31, respectively, to secure the resilient cushion layer 25 itself to the main top rail member when the cushion layer is applied to the latter.

The resilient cushion layer 25 also has openings 37 and 38 in the dovetail tenons 35 and 36, respectively and the openings 37 and 38 extend through the respectively associated tenons in the longitudinal direction of the associated top rail 10, 11, 12 or 13 so that the dovetail tenons 35 and 36 can be easily fitted in the respectively associated dovetail tenon slots 30 and 31. Similarly, the resilient cushion layer 25 has a cushion opening 39 in an upper portion above the openings 37 and 38 extending in the longitudinal direction of the top rail 10, 11, 12 or 13 so as to improve the cushioning effect of the resilient cushion layer 25. Furthermore, the resilient cushion layer 25 has the surface protection layer 26 integrally formed with the outer surface of the cushion layer.

The surface protection layer 26 is formed by extruding high wear-resistance synthetic resins such as polyvinyl chloride, polypropylene, polyethylene, polyurethane, and polyamid through a suitable extruder or an extruding die simultaneously as the resilient cushion layer 25 is formed in the manner described hereinabove so that the surface protection layer 26 will be integral with the resilient cushion layer 25.

Since the outer surface of the resilient cushion layer 25 is covered by the surface protection layer 26 in the manner described hereinabove, any bleeding trace and/or surface irregularity on the cushion layer which may appear when the resilient cushion layer 25 is extruded can be concealed by the surface protection layer 26 to thereby impart an excellent buffering or cushioning effect to the cushion layer as well as rigidity and a pleasant appearance.

Both the extruded main top rail member 24 and the resilient cushion layer 25 having the surface protection layer 26 integrally formed therewith are connected to the railing construction 40, 41, 42 or 43 by fitting the slot 27 in the main top rail member 24 onto the upper ends of the support posts 44 or, more particularly, the upper ends of the auxiliary post portions 46 and securing the main top rail member 24 to the auxiliary post portions by means of threaded bolts or screws 53 whereby the main top rail member 10, 11, 12 or 13 bridges the support posts 44.

Next, the resilient cushion layer-surface protection layer assembly 25, 26 is applied to the main top rail member 24 by pressing the layer assembly against the main top rail member from above and fitting the groove 32 in the resilient cushion layer 25 onto the main top rail member 24.

Thereafter, the opposite sides of the resilient cushion layer 25 are pressed against the main top rail member 24 and the dovetail tenons 35 and 36 integrally formed on the opposite sides of the groove 32 are fitted into the corresponding dovetail tenon slots 30 and 31 formed in the opposite sides of the main top rail member 24 to secure the resilient cushion layer-surface protection layer assembly 25, 26 to the main top rail member 24 whereby the top rail member 10, 11, 12 or 13 is connected to the support posts 44 bridging the posts.

In this manner, the top rail member 10, 11, 12 or 13 can be simply mounted on the support posts 44 without the use of any hot air blower.

Figure 9:
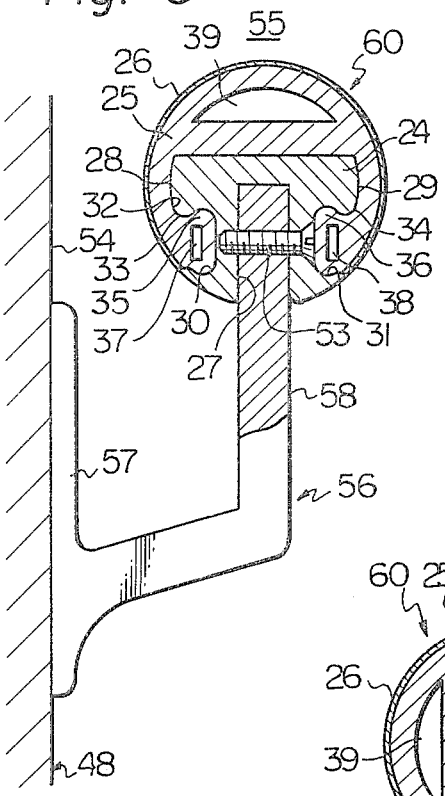
FIG. 9 is a cross-sectional view of a wall-mounted railing to which the top rail of the invention is applied.

FIG. 9 shows a top rail 60 having the same cross-sectional configuration as that of the top rail members 10, 11, 12 and 13 as shown in FIGS. 1 through 8 and applied to a railing construction 55 which is secured to a building wall.

The wall-mounted railing construction 55 comprises a plurality of mounting brackets 56 secured to a wall face 54 of a building 48 in a suitably spaced relationship to each other and the top rail 60 is secured to the upper ends of the brackets 56 to bridge the brackets.

The bracket 56 comprises an anchoring portion 57 secured to the wall face 54 by being fastened to an anchor bolt (not shown) embedded in the wall face by means of a nut (not shown) and a L-shaped support arm 58 integrally formed with the anchoring portion 57. The top rail 60 is secured to the support arms 58 by inserting the leading or free ends of the support arms 58 into the slot 27 in the main top rail member 24 and securing the main top rail member 24 to the support arms 58 by means of tapping rivets 53.

As in the case of the top rails 10, 11, 12 and 13 referred to hereinabove, the top rail 60 comprises the main top rail member 24, resilient cushion layer 25 and surface protection layer 26 and is formed by integrally forming the surface protection layer 26 on the outer surface of the resilient cushion layer 25 and then attaching the cushion layer-surface protection layer assembly to the main top rail member 24.

Thus, the components of the top rail 60 are designated by the same numerals as those given to the corresponding parts of the top rails 10, 11, 12 and 13, respectively and a detailed description of these parts will be omitted herein. And since the connection of the top rail 60 to the mounting brackets 56 is effected in the same manner as described in connection with the connection of the top rail 10, 11, 12 or 13 to the support posts 44, a description of such connection of the top rail 60 to the brackets 56 will be also omitted herein.

Figure 10:
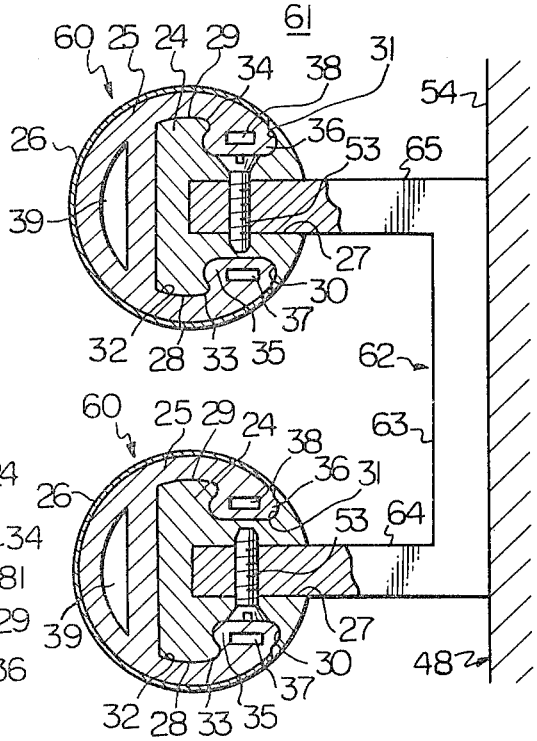
FIG. 10 is a cross-sectional view of a safety railing mounted on a floor wall face and having the top rail of the invention applied thereto.

FIG. 10 shows two top rails 60 of FIG. 9 having the same cross-sectional configuration as the top rails 10, 11, 12 and 13 of FIGS. 1 through 8 and applied to a modified railing 61 secured to a building wall face.

The railing construction 61 of FIG. 10 represents a modification of the railing construction 55 of FIG. 9 and has two top rails 60 connected thereto in parallel to each other and at different heights.

That is, the railing construction 61 comprises a plurality of mounting brackets 62 secured to the wall face 54 of the building 48 at suitably spaced relationship and the two top rails 60 bridging and secured to the mounting brackets 62.

The mounting bracket 62 comprises an anchoring portion 63 secured to the wall face 54 by being fastened to an anchor bolt (not shown) embedded in the wall face by means of a nut (not shown) and a pair of parallel support arms 64 and 65 integrally formed with the upper and lower ends of the anchoring portion 63. The top rails 60, are connected to the leading or free ends of the support arms 64 and 65 by fitting the slots 27 in the main top rail members 24 and securing the main top rail members 24 to the support arms 64 and 65 by means of threaded bolts or screws 53.

Since the top rails 60 correspond to the top rail 12, the top rails 60 can be connected to the railing construction 55 in the same manner as that by which the top rails 10, 11, 12 and 13 are connected to the railing.

Figure 11:
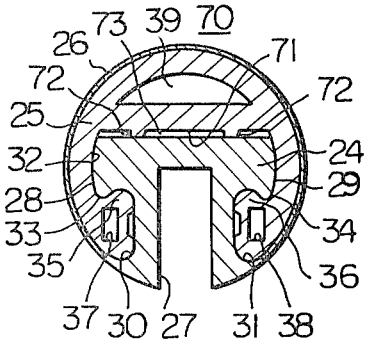
FIG. 11 is a cross-sectional view of a modification of the top rail of FIG. 7.

FIG. 11 shows a modification 70 of the top rails 10, 11, 12, 13 and 60 and the modified top rail 70 comprises the main top rail member 24, the resilient cushion layer 25 and the surface protection layer 26. In this embodiment, the resilient cushion layer 25 has a downwardly open 32 the top wall of which is provided with two ribs 72 projecting therefrom.

The ribs 72 are suitably spaced in the direction of the width of the groove 32 and extend in the longitudinal direction of the top rail 70.

When the resilient cushion layer 25 is fitted on the main top rail member 24, the ribs 72 provide a slight clearance 73 between the main top rail member 24 and resilient cushion layer 25. However, the ribs 72 make it possible to easily fit the resilient cushion layer 25 on the main top rail member 24 without causing any uneveness in the thickness of the resilient cushion layer 25.

Figure 12:
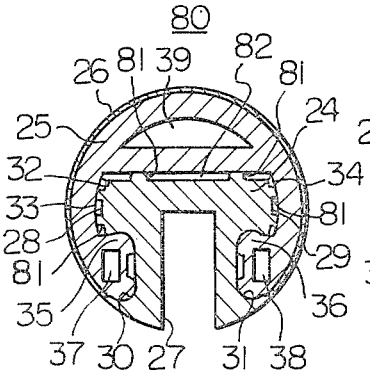
FIG. 12 is a fragmentary cross-sectional view of a further modification of the top rail of FIG. 7.

FIG. 12 shows a modification 80 of the top rail 70 and the modified top rail 80 comprises the main top rail member 24, resilient cushion layer 25 and surface protection layer 26. In the embodiment of FIG. 12, the surface of the portion of the main top rail member 24 which contacts the groove 32 has a plurality of ribs 81 integrally formed therewith.

The ribs 81, of course, extend in the longitudinal direction of the top rail 80 and when the resilient cushion layer 25 is fitted on the main top rail member 24, the ribs 81 provide a slight clearance 82 between the main top rail member 24 and resilient cushion layer 25 and make it possible to fit the resilient cushion layer 25 on the main top rail member 24 without causing any uneveness in the thickness of the resilient cushion layer 25.

Figure 13:
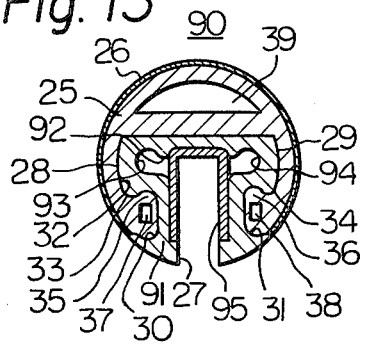
FIG. 13 is a fragmentary cross-sectional view of a further modification of the top rail of FIG. 7.

FIG. 13 shows a further modification 90 of the foregoing top rails 10, 11, 12, 13, 60, 70 and 80 and the modified top rail 90 is formed of rigid synthetic resins such as polyvinyl chloride, polycarbonate, acrylate resin, and melamine, is light in weight and is less expensive. In the modified top rail 90, although the main top rail member 91 is formed by continuously extruding the resin through an extruder or an extruding die, the main top rail member 91 has a higher rigidity than the corresponding parts of the foregoing top rails.

As more clearly shown in FIG. 13, the top rail 90 has a substantially circular cross-section configuration and includes the main top rail member 91, the resilient cushion layer 25, the surface protection layer 26 integrally laminated on the resilient cushion layer 25 and a metal reinforcing channel member 95 resiliently fitted in the post receiving slot 27 in the main top rail member 91.

The main top rail member 91 of the top rail 90 is formed of rigid synthetic resins such as polyvinyl chloride, polycarbonate, acrylate resin, and melamine and has the post receiving slot or mounting slot 27 extending in the longitudinal direction of the top rail and opening downwardly. Similarly, the main top rail member 91 has formed on the left- and righthand side faces 28 and 29 thereof dovetail tenon slots 30, 31 extending in the longitudinal direction of the top rail. Especially, in order that the reinforcing channel member 95 be resiliently received in the post receiving slot 27, the top wall 92 of the post receiving slot 27 has formed at the opposite corners relief spaces 93 and 94.

The relief spaces 93 and 94, of course, extend in the longitudinal direction of the top rail member main body 90 and the main top rail member 91 is formed by an extruder and an extruding die. The reinforcing channel member 95 is formed of relatively less expensive metal material.

Thus, as in the case of the foregoing top rails 10, 11, 12 and 13, the top rail 90 is connected to the support posts 44 and more particularly, the auxiliary support post portions 46 so as to bridge the support posts 44.

Figure 14:
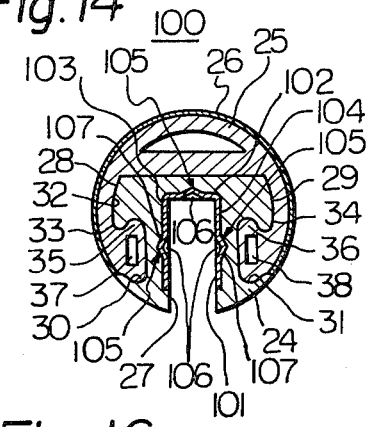
FIG. 14 is a fragmentary cross-sectional view of another embodiment of the top rail of the invention.

FIG. 14 shows a modification 100 of the top rail 90 and the modified top rail 100 includes the main top rail member 24 formed of rigid synthetic resin, the resilient cushion layer 25 fitted on the main top rail member 24, the surface protection layer 26 integrally laminated on the resilient cushion layer 25 and metal reinforcing channel member 101 integrally extruded onto the main top rail member 24 so as to form the inner wall surface of the post receiving slot 27 in the main top rail member 24.

Since the metal reinforcing channel member 101 is integrally secured to the main top rail member 24, the relief spaces 93 and 94 as provided in the main top rail member of FIG. 13 can be eliminated from the main top rail member 91 of FIG. 14.

The reinforcing channel member 101 is formed of relatively less expensive metal material and includes a web portion 102 and opposite flanges 103 and 104. The web portion and opposite flanges have formed therein connection means 105 in suitably spaced relationship in the longitudinal direction of the top rail 100.

Each of the connection means 105 includes holes 106 formed in the associated channel member 101 and bridge-shaped projections 107 bridging the holes 106 and projecting outwardly of the channel member 101.

Since the plurality of connection means 105 are preformed on the channel member 101 as the reinforcing channel member 101 passes through the extruding die when the main top rail member 24 is formed with the reinforcing channel member 101 incorporated therein, the fused resin of the main top rail member 24 positioned on the outer surface of the channel member 101 flows into the open cavities defined by the holes 106 and bridge-shaped projections 107 and firmly adheres to the channel member 101. Furthermore, the holes 106 formed in the channel member 101 cause the fused resin oozing or bleeding along the outer surfaces of the channel member 101 to serve a further important purpose. That is, the bleeding fused resin serves as the lubricant for the laminated product which passes through the extruding die. This eliminates the necessity for the use of any lubricant in the extruding step and the additional step of removal of any such lubricant at the end of the extruding step. Furthermore, the bleeding fused resin serves to alleviate unbalance in pressure on the channel member 101 which may take place under the extrusion pressure acting on the channel member while the channel member is passing through the extruding die.

In addition, the fused resin flowing into the open cavities acts on the inner surface of the bridge-shaped projections 107 so as to raise the channel member 101 from the bottom of the die a small distance whereby the laminated product can be easily extruded.

Thus, as in the case of the top rail 90 referred to hereinabove, the top rail 100 is also connected to the support posts so as to bridge the posts.

Figure 15:
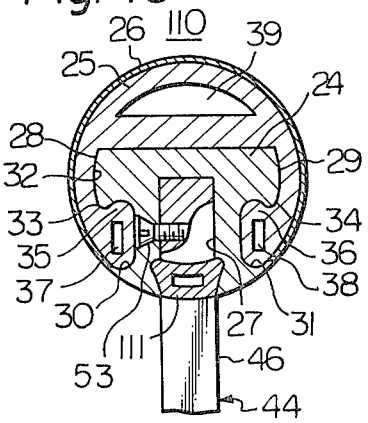
FIG. 15 is a fragmentary cross-sectional view of a further embodiment of the top rail of the invention having resilient filling members incorporated therein.

FIG. 15 shows a further modification 110 of the top rail 10 and the top rail 110 is modified by adding resilient filling member 111 to the top rail 10. In addition to the filling members 111, the top rail 110 includes the aluminum main top rail member 24, the resilient cushion layer 25 and the surface protection layer 26 integrally laminated on the resilient cushion layer 25.

Each resilient filling member 111 is fitted in the post receiving slot 27 in the main top rail member 24 between each two adjacent support posts 44 and more particularly, between each two adjacent auxiliary post portions 46 to fill up the space between each two adjacent auxiliary post portions 46 in the slot 27 to thereby prevent a user's finger being caught in the slot 27 between the posts 44 and improves the touch and appearance of the top rail 110.

Figure 16:
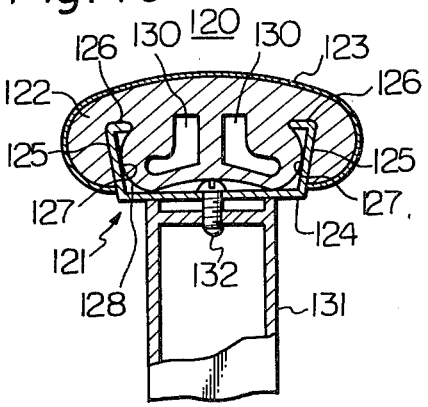
FIG. 16 is a fragmentary cross-sectional view of a further modification of the top rail of FIG. 7.

FIG. 16 shows a further modification 120 of the top rail 10 and the modified top rail 120 includes the main top rail member 121 formed by extruding aluminum or aluminum alloy, the resilient cushion layer 122 attached to the main top rail member 121 and the surface protection layer 123 integrally laminated on the resilient cushion layer 122.

The main top rail member 121 is connected to the support posts 131 by bridging the adjacent support posts 131 by means of the web portions 124 of the main top rail member and securing the web portions 124 to the support posts 131 and in order to firmly secure the resilient cushion layer 122 to the main top rail member 121, the flanges 125 of the web portions 124 have integrally formed at the leading or free ends lips 126.

The resilient cushion layer 122 is formed of soft vinyl chloride or soft foamed vinyl chloride and has a substantially egg-shaped cross-sectional configuration.

The resilient cushion layer 122 has a pair of flange receiving slots 127 which extend in the longitudinal direction of the main top rail member 121 and open downwardly for receiving the flange portions 125 on the main body 121.

Especially, in order to resiliently receive and engage the flange portions 125, the inner surfaces of the slot 127 are formed by the opposite side faces of the center bead portion 128. The center bead portion 128 of the slot 127 has a pair of openings 130 extending in the longitudinal direction of the top rail 120 so that the slot 127 can resiliently engage the flange portions 125 and lips 126 received therein.

As in the case of the surface protection layer 26 in the foregoing top rail 10, the surface protection layer 123 is formed of high wear-resistance synthetic resin.

Thus, the main top rail member 121 and the resilient cushion layer 122 having the surface protection layer 123 integrally laminated thereon are connected to the upper or free ends of the support posts by positioning the main top rail member 121 having the resilient cushion layer 122 and surface protection layer 123 incorporated therein so as to bridge the support posts 131 and securing the main top rail member 121 to the posts by means of bolts or screws 132.

The resilient cushion layer 122 is then pressed against the main top rail member 121 from above and the flange portions 125 are resiliently pressed into the slot 127 so as to firmly fit the resilient cushion layer 122 on the main top rail member 121 whereby the thus assembled top rail 120 is held in position on the support posts 131 bridging the posts.

Figure 17:
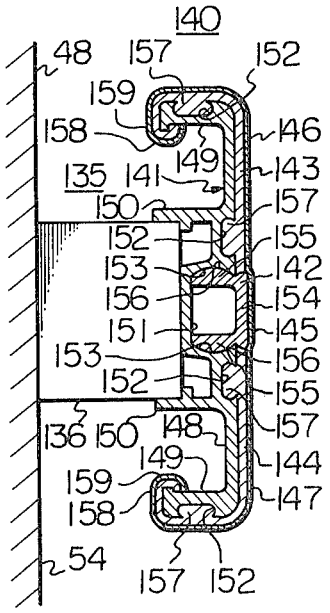
FIG. 17 is a cross-sectional view of a wall-mounted railing to which a further modification of the top rail of FIG. 10 is applied.

FIG. 17 shows a further modified top rail 140 of the invention applied to a railing construction 135 secured to a building wall face.

The railing construction 135 comprises anchor blocks 136 secured at the wall face 54 of a building 48 at suitably spaced points in the longitudinal direction of the railing construction and the top rail member 140 secured to the anchor blocks 136.

The anchor block 136 is formed of a square cross-section block extending in the longitudinal direction of the top rail 140 and is secured to the wall face 54 by being fastened to an anchor bolt (not shown) embedded in the wall face by means of a nut (not shown).

The top rail 140 includes the main top rail member 141, the center resilient cushion layer 142 and a pair of side resilient cushion layers 143 and 144 on the opposite sides of the center resilient cushion layer 142 all of which layers are fitted on the outer surface of the main top rail member 141 and the surface protection layers 145, 146 and 147 integrally laminated on the outer surfaces of the resilient cushion layers 142, 143 and 144, respectively.

The top rail 141 is formed by extruding aluminum or aluminum alloy which is then processed and includes the web portion 148, a pair of flanges 149 integrally formed with the opposite edges of the web portion 148 and protruding therefrom and a pair of laterally spaced flanks 150 projecting from the inner surface of the web portion 148 to fit on the block 136 and extending in the longitudinal direction of the top rail 140.

The main top rail member 141 further comprises the groove 151 opening out of the outer surface of the web portion 148 and extending in the longitudinal direction of the main top rail member 141 for receiving the center resilient cushion layer 142 and a plurality of dovetail tenon slots 152 for receiving the dovetail tenons 157 on the side resilient cushion layers 143 and 144.

The groove 151 is defined by the opposite side walls 153 the inner surfaces of which are recessed to receive the center resilient cushion layer 142 to hold the layer in position.

The center resilient cushion layer 142 is formed of soft vinyl chloride and has a channel-shaped cross-sectional configuration.

The center resilient cushion layer 142 is given its channel-shaped cross-sectional configuration by the web portion 154 and a pair of flange portions 155 integrally formed with the opposite side edges of the web portion 154. The surface protection layer 145 is integrally laminated on the outer surface of the web portion 154 and the outer surfaces of the flange portions 155 bulge outwardly as shown by numeral 156 for complementary engagement with the recessed side faces of the groove 151.

The side resilient cushion layers 143 and 144 are formed of the same soft vinyl chloride as that of which the center resilient cushion layer 142 is formed and have the surface protection layers 146 and 147 integrally laminated on the surfaces thereof, respectively. The dovetail tenons 157 project from the inner surfaces of the side resilient cushion layers 146 and 147 and extend in the longitudinal direction of the top rail 140 to be received in the dovetail tenon slots 152 in the main top rail member 151. The side resilient cushion layers 143 and 144 have formed at the outer ends 158 with bent end 159 to abut against the adjacent ends of the flange portions 149 so as to partially cover the flange portion ends.

The surface protection layers 146 and 147 are, of course, formed of high wear-resistance synthetic resin as in the case of the surface protection layers 26 in the top rail 10.

Thus, the top rail 140 of FIG. 17 is constructed to the railing construction first by securing the main top rail member 141 to the anchor block 136 by means of rivets (not shown), pressing the center resilient cushion layer 142 into the groove 151 in the main top rail member 141, pressing the side cushion layers 143 and 144 against the adjacent surfaces of the web portions 148 on the opposite sides of the groove 151, pressing the dovetail tenons 157 into the dovetail tenon slots 152 and pressing the bent portions 159 against the outer ends of the flange portions 149.

The top rail 140 of FIG. 17 is suitably employed in connection with a railing construction mounted on the wall face of a passageway in a hospital or a wall face adjacent to a staircase or a railing construction which serves as a support for patients who cannot walk without the support provided by the railing construction and which concurrently serves as the cushion for a wheeled chair or a wheeled beadstead or a wall face protection.

Figure 18:
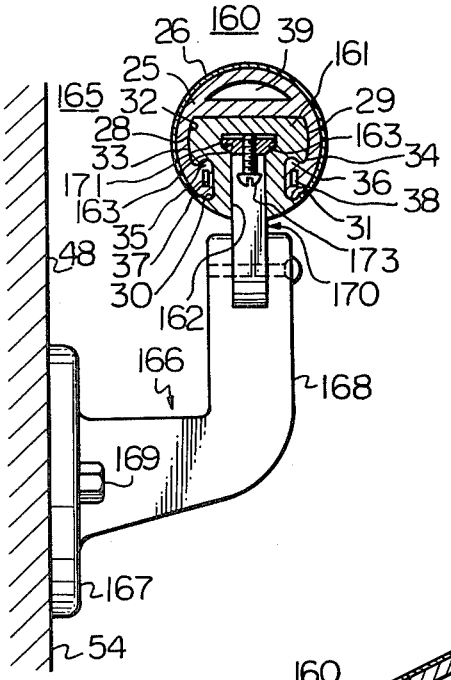
FIG. 18 is a fragmentary cross-sectional view of a staircase wall-mounted railing to which another embodiment of the top rail of the invention is applied.
Figure 19:
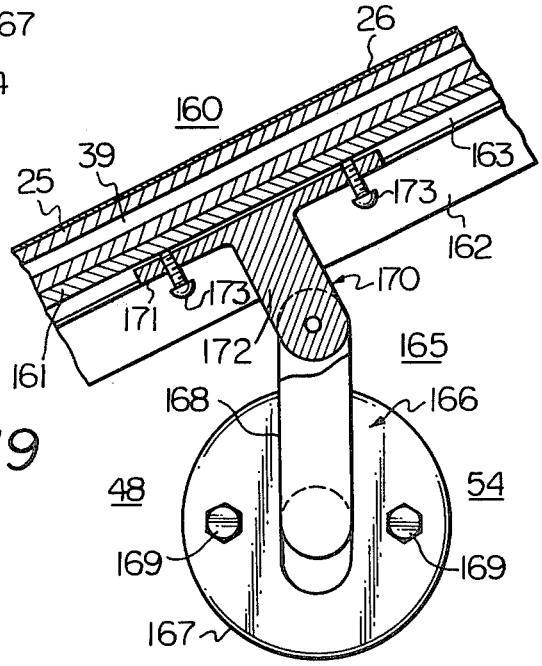
FIG. 19 is a fragmentary longitudinal sectional view taken in the longitudinal direction of said wall-mounted railing as shown in FIG. 18.

FIGS. 18 and 19 show a further modification 160 of the top rail 60 of FIG. 9 as being applied to a railing construction 165 secured to a building wall.

The railing construction 165 comprises a plurality of mounting brackets suitably secured to the wall face 54 of the building 48 at suitably spaced points in the longitudinal direction of the railing construction 165 and the top rail member 160 bridging and secured to the brackets 166 through connectors 170.

The mounting bracket 166 includes an anchor flange 167 secured to the wall face by means of an anchor bolt 169 and a L-shaped support arm 168 integrally formed with the anchor flange 167.

As in the case of the foregoing top rail 60, the top rail 160 of FIGS. 18 and 19 comprises the main rail top member 161 which represents a modification of the main top rail member 24 of the top rail 60, the resilient cushion layer 25 and the surface protection layer 26.

That is, the modified main top rail member 161 is provided with a modified post receiving slot 162 which represents a modification of the post receiving slot 27.

The support post receiving slot 162 in the main top rail member 161 additionally includes a pair of interior opposed longitudinally-extending slots or a pair of opposed interior longitudinally-extending recesses 163.

With the above construction of the support post receiving slot 162, the top rail 160 is secured to the wall face 54 through the mounting brackets 166 by inserting the connector 170 into the support post receiving slot 162 so as to position the liner 171 of the connector 170 in the recesses 163, securing the connector 170 to the support post receiving slot 162 by means of set screws 173 and then pinning the arm 172 of the connector 170 to the support arm 168.

Thus, the top rail 160 can be easily secured to or detached from the mounting brackets 166 by fastening or loosening the set screws 173.

While various embodiments of the invention have been shown and described in detail, it will be understood that these are for the purpose of illustration purpose only and are not to be taken as a definition of the scope of the invention, reference being had for this purpose to the appended claims.

What is claimed is:

1. A top rail for use on a railing construction or the like comprising a main top rail member having a support post receiving slot extending in the longitudinal direction of said top rail and opening downwardly, and dovetail tenon slots formed on the opposite sides thereof and extending in the longitudinal direction of said top rail;

a resilient cushion layer fitted on said main top rail member, a main top rail member receiving groove extending in the longitudinal direction of said receiving cushion into which said main top rail member fits for mounting said cushion layer on said main top rail member, and dovetail tenons projecting from the opposite side walls of said groove in the main top rail member and received in said dovetail tenon slots; and a surface protection layer integrally formed on the outer surface of said resilient cushion layer.

2. A top rail as claimed in claim 1, in which said main top rail member has a plurality of ribs extending in the longitudinal direction of said top rail and integrally formed with the surface of the portion of the main top rail member which fits in said main top rail member receiving groove.

3. A top rail as claimed in claim 1, in which said resilient cushion layer further has a an opening therethrough extending in the longitudinal direction of said top rail.

4. A top rail as claimed in claim 1, in which said resilient cushion layer is formed of thermoplastic synthetic resin, and said surface protection layer is formed of high wear-resistance synthetic resin.

5. A top rail as claimed in claim 1, in which said main top rail member is formed of rigid synthetic resin, and further includes a channel-shaped cross-section metal reinforcing member resiliently fitted in said support post receiving slot.

6. A top rail as claimed in claim 1, in which said main top rail member is formed of rigid synthetic resin, and further includes a channel-shaped cross-section metal reinforcing member integrally secured in said support post receiving slot.

7. A top rail as claimed in claim 6, in which said metal reinforcing member has a plurality of holes therein.

8. A top rail as claimed in claim 6, in which said metal reinforcing member has a plurality of projections embedded in said main top rail member.

9. A top rail as claimed in claim 1, in which said main top rail member further includes a plurality of resilient filling members fitted in said support post receiving slot each of which filling members extends between each two adjacent posts when a plurality of posts are received in the slot.

10. A top rail as claimed in claim 1 in which said resilient cushion layer has a plurality of ribs extending in the longitudinal direction of said top rail and integrally formed with and projecting from the surface of said main top rail member receiving groove and into said main top rail member receiving groove.

* * * * *